US008161582B2

(12) United States Patent
Hatrick-Smith

(10) Patent No.: US 8,161,582 B2
(45) Date of Patent: Apr. 24, 2012

(54) SHOWER ENCLOSURE AND BASE

(75) Inventor: John Hatrick-Smith, Glenfield (NZ)

(73) Assignee: Kohler New Zealand Limited, Glenfield, Auckland (NZ)

( * ) Notice: Subject to any disclaimer, the term of this patent is extended or adjusted under 35 U.S.C. 154(b) by 1141 days.

(21) Appl. No.: 10/593,534

(22) PCT Filed: Feb. 14, 2005

(86) PCT No.: PCT/NZ2005/000016

§ 371 (c)(1), (2), (4) Date: Sep. 19, 2006

(87) PCT Pub. No.: WO2005/077235

PCT Pub. Date: Aug. 25, 2005

(65) Prior Publication Data

US 2007/0067903 A1 Mar. 29, 2007

(30) Foreign Application Priority Data

Feb. 13, 2004 (NZ) ..... 531166

(51) Int. Cl.
*A47K 3/00* (2006.01)

(52) U.S. Cl. ..... 4/607

(58) Field of Classification Search ..... 4/607, 612–614
See application file for complete search history.

(56) References Cited

U.S. PATENT DOCUMENTS

| | | | | |
|---|---|---|---|---|
| 999,858 | A * | 8/1911 | Payne | 4/612 |
| 5,243,716 | A * | 9/1993 | Zaccai et al. | 4/613 X |
| 5,911,518 | A * | 6/1999 | Jurek et al. | 4/613 X |
| 6,014,780 | A | 1/2000 | Jurek et al. | |
| 6,178,571 | B1 | 1/2001 | McAllister | |
| 6,381,773 | B1 | 5/2002 | McAllister | |
| 6,792,721 | B1 * | 9/2004 | Montanari | 4/612 X |
| 7,490,371 | B2 * | 2/2009 | Torres | 4/613 |
| 2002/0066140 | A1 | 6/2002 | Gerloff | |
| 2006/0182926 | A1 * | 8/2006 | Lewis et al. | 428/68 |

FOREIGN PATENT DOCUMENTS

| | | | |
|---|---|---|---|
| DE | 4403653 | C | 7/1995 |
| DE | 19631232 | A | 2/1998 |
| EP | 0492147 | B1 | 10/1997 |

(Continued)

OTHER PUBLICATIONS

International Search Report, together with Written Opinion, corresponding to PCT/NZ2005/000016, under date of mailing of May 6, 2005, 8 pgs.

(Continued)

*Primary Examiner* — Lori Baker
(74) *Attorney, Agent, or Firm* — Foley & Lardner LLP

(57) ABSTRACT

A shower enclosure comprises a shower base (5) having a floor (6) which falls towards a side of the shower base (5), a waste outlet at said side of the shower base, and a drain channel (11) which extends exterior to the door (1) of the enclosure, and which is arranged to drain towards the waste outlet (8). Water may flow beneath the door (1) to the drain channel (11). Preferably the drain channel (11) also extends along a foot of the return panel(s) (2). A longitudinally extending cover member (9) is preferably provided over the drain channel (11) and the waste outlet (8) may be provided at the front side of the shower base (5).

23 Claims, 5 Drawing Sheets

FOREIGN PATENT DOCUMENTS

| | | | |
|---|---|---|---|
| EP | 1098041 | A | 5/2001 |
| EP | 1210897 | A | 6/2002 |
| EP | 1262133 | A | 12/2002 |
| GB | 2093342 | A | 9/1982 |
| GB | 2108382 | A | 5/1983 |
| GB | 2306316 | A | 5/1997 |
| GB | 2315999 | A | 2/1998 |
| NZ | 517537 | | 8/2003 |
| WO | WO 01 08540 | A | 2/2001 |
| WO | WO 01 73231 | A | 10/2001 |

OTHER PUBLICATIONS

International Preliminary Report on Patentability corresponding to PCT/NZ2005/000016, under date of completion of Mar. 21, 2006, 3 pgs.

* cited by examiner

SHOWER ENCLOSURE AND BASE

CROSS-REFERENCE TO RELATED APPLICATIONS

This application claims the benefit of International Patent Application PCT/NZ2005/000016 FILED 14 Feb. 2005, which claims the benefit of NZ application 531166 filed 13 Feb. 2004.

FIELD OF INVENTION

The invention relates to a preformed shower base for a shower enclosure and to a shower enclosure.

BACKGROUND OF THE INVENTION

A shower enclosure consists for example of a door and return panel or panels which are fitted in the corner of a bathroom or other area to form together with the existing corner walls of the room (which are lined with an appropriate waterproof lining) a shower cubicle (though not necessarily of square floor shape). Commonly before installing the door and return panel(s), a pre-fabricated or pre-formed shower base is installed which provides a floor to the shower enclosure on which a person stands when using the shower. The shower base includes a waste aperture in which is provided a waste fitting connected to plumbing which carries away waste water during use of the shower.

The shower base is formed so that the upper surface of the shower base which provides the floor of the shower falls towards the waste outlet. Commonly the pre-formed shower base is thermoformed to shape from sheet thermoplastic material. The exposed upper surface of the thermoformed material of the shower base may constitute the finished surface of the floor of the shower. Alternatively, a pre-formed shower base may be fabricated from fibreglass or stainless steel for example.

Alternatively again the floor of a shower may be tiled, with ceramic or clay tiles. The tiles must be solidly supported or they may crack or become dislodged. The tiles may be fixed directly on the floor of the room or area in which a shower enclosure is being installed, on for example a concrete floor surface which has been pre-formed with a fall to a waste outlet. It is also known to install on the floor a pre-formed shower base intended to be tiled, which provides a stable surface with a fall or falls to a waste outlet for solidly supporting the tiles. U.S. Pat. No. 6,381,773 discloses a pre-formed planar shower base having a waste positioned at the entry side of the shower base with associated drain channels.

UK patent application publication 2093342 discloses a pre-formed shower base having a central square floor and a peripheral drain channel which takes water to a corner waste.

European patent 0492147 discloses a pre-formed shower base having a non-central waste and a peripheral drain channel.

SUMMARY OF INVENTION

It is an object of the invention to provide an improved or at least alternative form of pre-formed shower base and/or shower enclosure which is particularly suitable for installing or providing a shower enclosure intended to have a tiled floor.

In broad terms in one aspect the invention comprises a pre-fabricated shower base for use in installing a shower in a room, which shower base has a floor which falls towards a front side of the shower base and which comprises substantially a single plane whereby the floor of the shower base may be tiled without requiring cutting of flat tiles to accommodate changes in plane of the floor of the shower base, a waste outlet at said front side of the shower base, and which is associated with a drain channel which extends around or across the front side of the shower base and which is arranged to drain into the waste outlet, and a formation or formations around a part of a front side of the shower base for mounting to the shower base a return panel or panels of a shower enclosure on one or both sides of a door of the shower enclosure.

In broad terms in one aspect the invention comprises a shower enclosure and a shower base having a floor which falls towards a side of the shower base, a waste outlet at said side of the shower base, and a drain channel which extends around or across the front side of the shower base at least beneath and exterior to the door of the enclosure, and which is arranged to drain towards the waste outlet, a shower base having a floor which falls towards the front a side of the shower base, a waste outlet at the front side of the shower base, and which is associated with a drain channel which extends around or across the front side of the shower base at least beneath and exterior to the door of the enclosure, and which is arranged to drain into the waste outlet.

In a preferred form the shower enclosure comprises a door and one or more return panels, and the drain channel is provided to extend along or adjacent to the foot of the return panel(s) as well as beneath or at the foot of the door of the shower enclosure, to the waste outlet which is provided on one side which is preferably the front side of the shower base. The shower base or enclosure may be of any shape (in plan). Alternatively however the shower enclosure may be intended to form a shower cubicle in a space comprising solid walls on three sides and the shower enclosure may comprise in addition to the base simply a door without a return panel (or optionally with a short return panel) which will extend between the walls to form the finished cubicle. Alternatively again, the shower base may be designed to be used with a freestanding shower enclosure.

Many pre-formed shower bases have a central waste aperture. In for example a square shower base with a central waste aperture, in order to provide a fall from each side of the shower base to the waste aperture, the floor surface of the shower comprises surfaces in four planes, which intersect along lines from each corner of the shower base to the waste outlet. Where the shower base is to be tiled, this requires cutting of many tiles where they intersect along each such line between adjacent planes in the floor surface of the shower base. This makes the tiling of the shower base relatively time consuming. In a preferred form, in the shower base of the invention which has a waste outlet to one side of the shower base combined with an associated drain channel, the floor surface of the shower base may substantially planar, ie a single plane, which requires less cutting of tiles at any change of plane in the floor surface of the shower base, when tiling the shower base.

The term 'comprising' as used in this specification and claims means 'consisting at least in part of', that is to say when interrupting independent claims including that term, the features prefaced by that term in each claim will need to be present but other features can also be present.

BRIEF DESCRIPTION OF THE DRAWINGS

The invention is further described with reference to the accompanying drawings which show a preferred form shower base and enclosure of the invention, by way of example and without intending to be limiting. In the drawings.

DETAILED DESCRIPTION OF PREFERRED FORM

Figure 1:
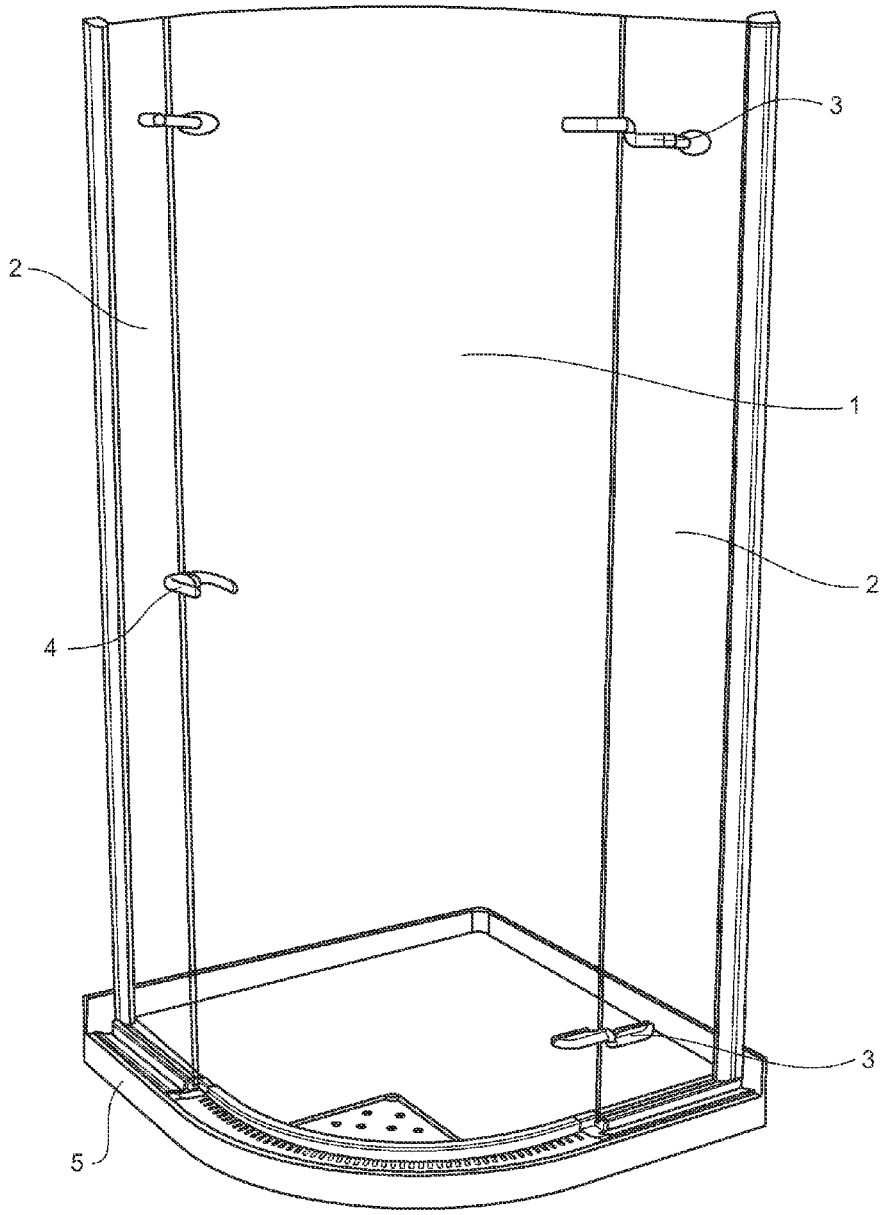
FIG. 1 is a perspective view of a shower enclosure including the preferred form shower base, from the front.

The preferred form shower base and shower enclosure shown in the drawings are intended for providing a shower cubicle in the corner of a room, with the enclosure having a curved door 1 with return panels 2 on either side as shown. The door is supported from the return panel by hinges 3 on one side of the door and includes a handle 4. However, shower bases and enclosures of the invention may be square in shape, or of any other plan shape as desired.

Figure 2:
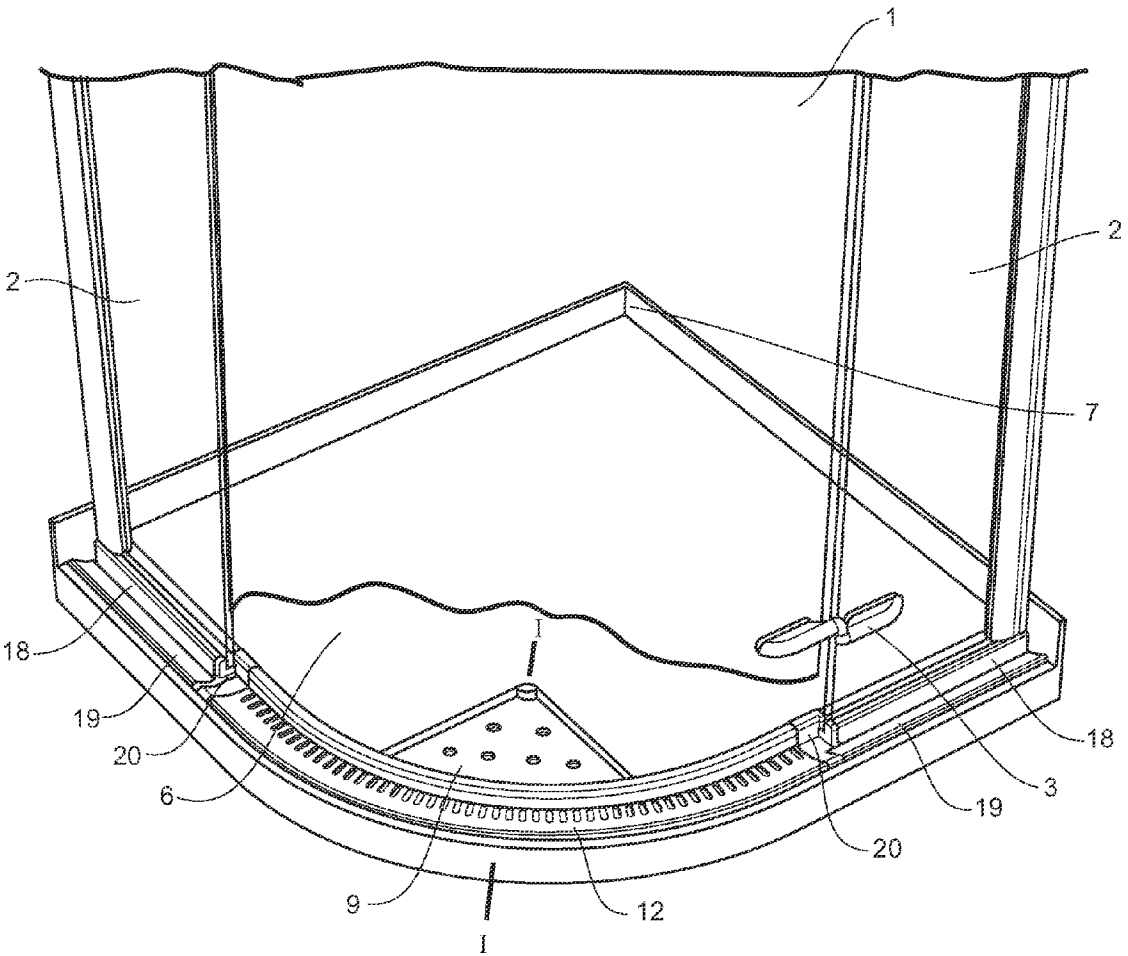
FIG. 2 is a larger view of the shower base from the front.

Referring to FIG. 2 the preferred form shower base 5 comprises a floor 6 which is a planar floor, and which falls or slopes from a high point at the rear side of the shower base, in this case from the rear corner 7, to a waste outlet 8 provided at the front side of the shower base. In the preferred form the waste outlet aperture 8 is also recessed into the shower base so as to be at a lower level than the floor surface 6 of the shower base, and cover member or plate 9 is provided which sits on ledges 10 formed in the shower base adjacent the waste aperture 8 as shown, preferably so that the cover plate is freely removable for cleaning. Ledge 10 on upstand 14 also supports the cover plate 9. In the preferred form the waste outlet aperture 8 is recessed into a generally triangular recess bounded by ledges 10 on either side and upstand 14 which together support the cover plate 9, but alternatively such a recess could be semi-circular square or any other suitable shape, preferably with a correspondingly shaped matching cover member. It is preferred but not necessarily essential that the waste outlet aperture 8 is recessed into the shower base so as to be at a lower level than the floor surface of the shower base and to provide a matching cover plate, so that the waste outlet aperture is not exposed providing a more aesthetically pleasing finished shower base, but in an alternative form the waste outlet aperture 8 may be exposed without any such cover member, as is conventional, but at one side of the shower base in accordance with the invention.

Figure 4:
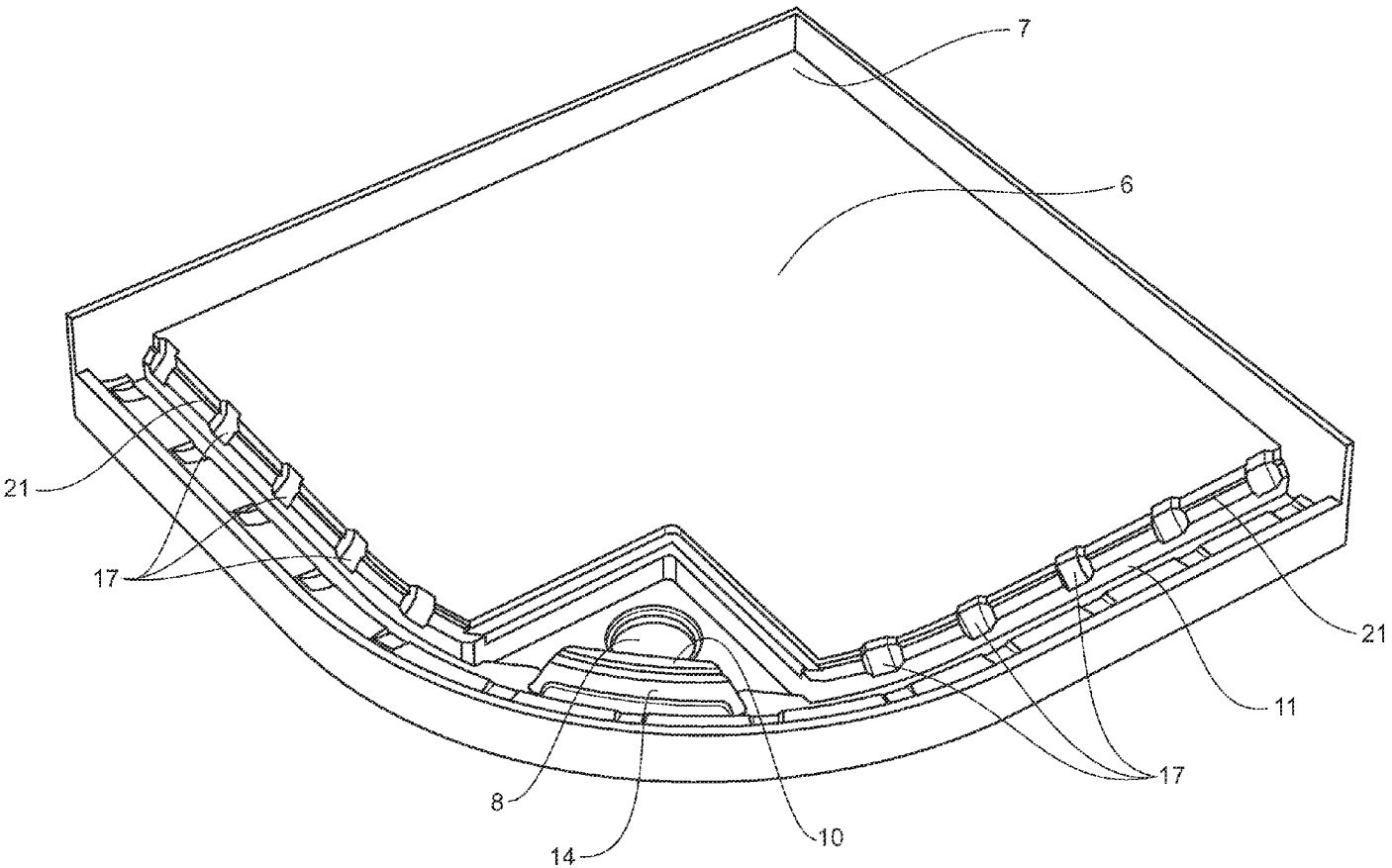
FIG. 4 is a view of the shower base from the front separate from the enclosure (for example before installation of the shower base) also with the drain cover plate and other components removed.

Drain channel 11 extends around the front of the shower base, at least beneath or at the foot of the door 1 and exterior to the door as shown, and also preferably along the foot of and exterior to the return panels 2 as shown. FIG. 4 shows the drain channel 11 most clearly, which is integrally formed in the shower base. After installation and in use of the shower, the fall of the floor surface of the shower base which may be tiled or alternatively may be formed as the finished end surface of the shower base, is towards the curved front side of the shower enclosure bounded by the door and return panels, and water will flow beneath the door 1 and into the drain channel 11 and to the waste outlet 8. Preferably the front side of the shower base is not higher than the floor 6 of the shower base adjacent to the door 1. Typically the shower base whether it is intended to be tiled or otherwise will be formed as a single thermoformed or moulded product and it may optionally preferably formed to also incorporate moulded cut outs 17 down which water falling towards either side of the front of the shower enclosure will fall, to the drain channel 11.

Preferably for aesthetic reasons a cover member or plate 12 is also provided over the drain channel 11 at least adjacent the door of the enclosure, which covers the drain while at the same time allowing water flowing towards the drain and onto the cover plate to drain through the cover plate which is apertured, in the preferred form with slots 16 as shown. The drain channel 11 may extend beyond simply the door, and may also extend along the foot of the one or more return panels. The drain channel in front of the return panels may be open but in the preferred form is also covered as shown, by short cover plates 19. By comparing FIGS. 2 and 3 it can be seen that rail 18 along the foot of each of the return panels is fixed adjacent the drain channel 11 on either side of the shower, and cover plate 19 which is removable for cleaning, fits in place to conceal the drain channel. Moulded plastic component 20 may be provided to finish the otherwise exposed end of the rail 18 (see FIG. 2) on either side. The cover plates 12 and 19 over the drain channel 11 may be formed as extrusions, or alternatively as moulded components, preferably with a surface which slopes back towards the floor of the shower base such as a concave upper surface 15 as shown (see FIG. 5).

There is a non-sealed gap between the bottom edge of the door and the shower base i.e. a sealing member or similar is not provided on the lower edge of the door which seals to the shower base, so that water flowing down the shower base towards the drain channel 11 exterior to the door may flow beneath the door and into the drain channel. It is also preferred that a frame such as a frame made up of extruded aluminium frame members, and seals, is/are not provided around the door entirely, so that the enclosure consists substantially of glass panels, and so that there will be a gap between one or both sides of the door of the enclosure and the return panel on one side or return panels on both sides of the door. This provides a cleaner and more aesthetically pleasing appearance to such a frameless shower enclosure, and while water may pass through the non-sealed gap(s) around the door, water dribbling down this gap will be caught in the drain channel 11.

Figure 3:
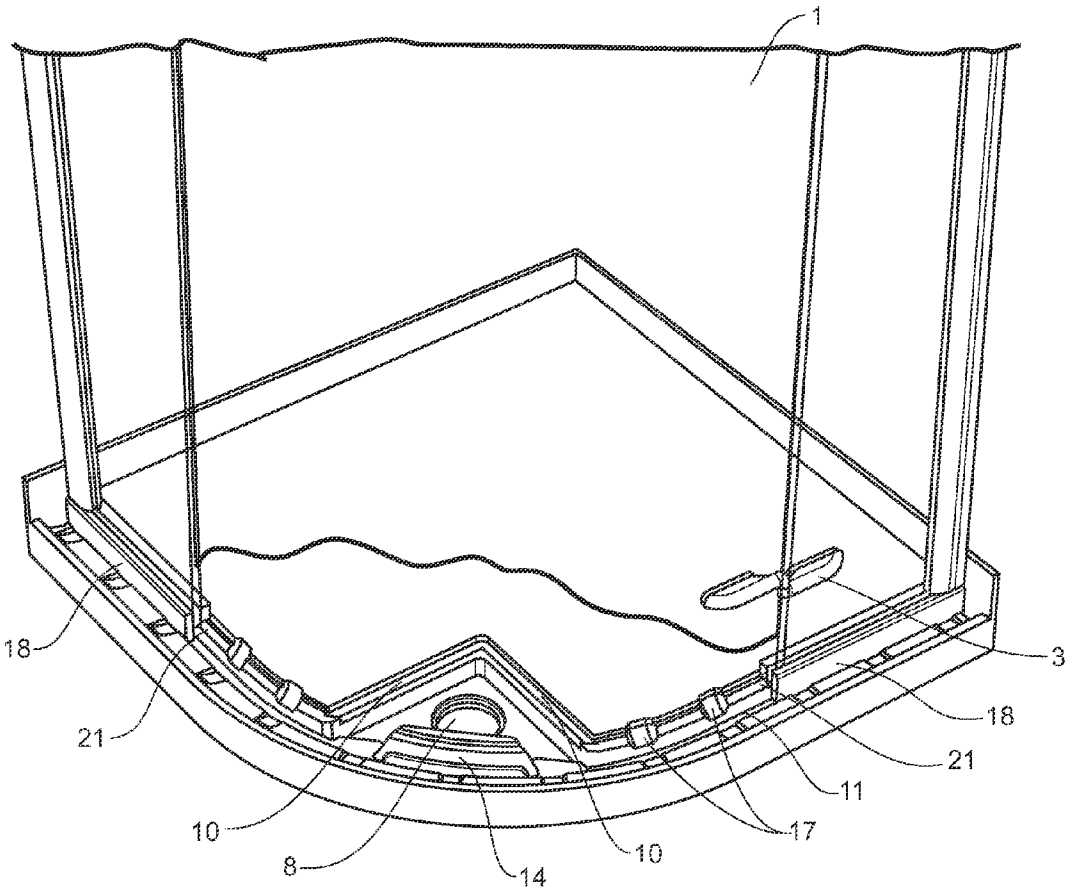
FIG. 3 is a view similar to FIG. 2 above with a drain channel cover removed.
Figure 5:
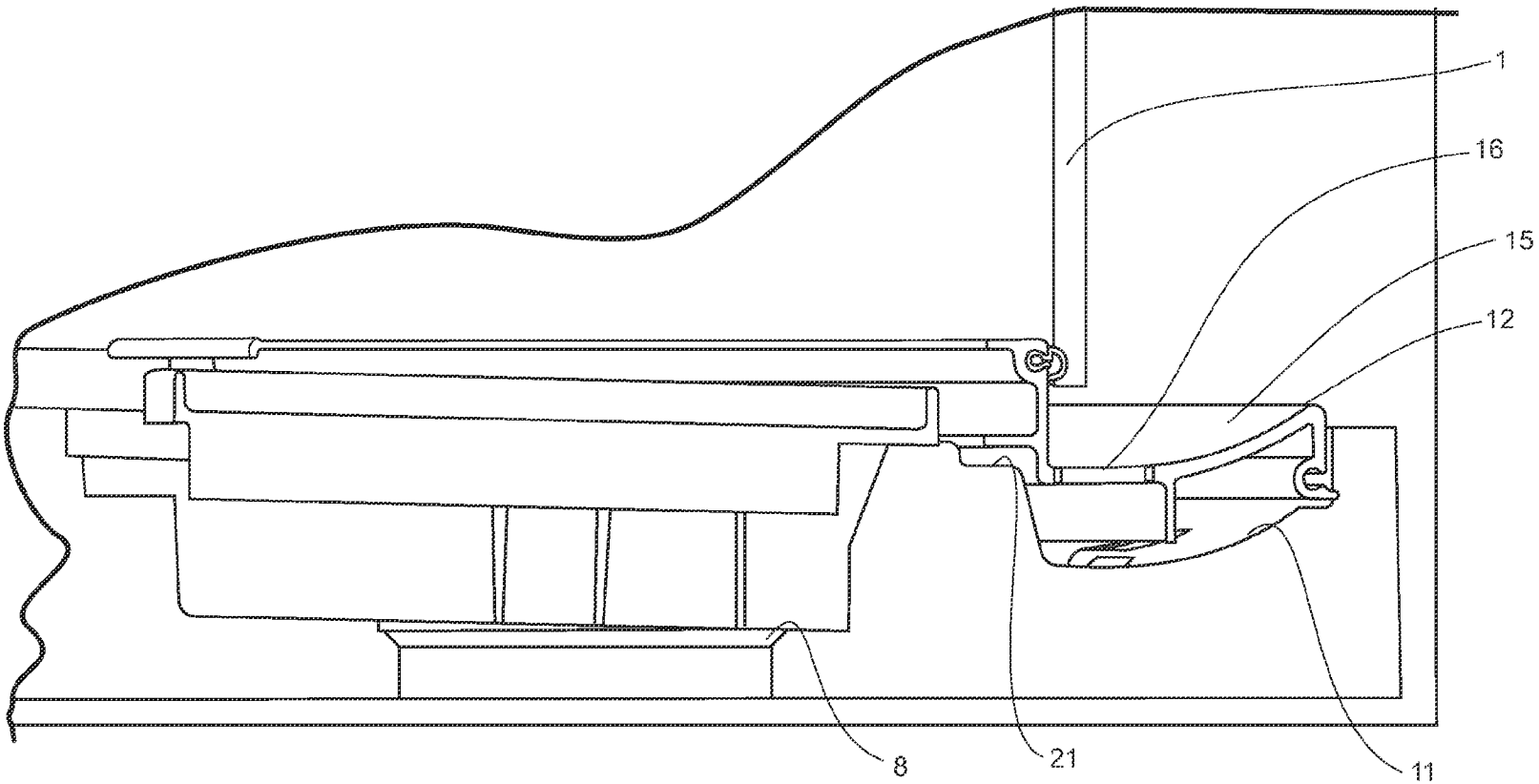
FIG. 5 is a cross-section schematic view of a part of the shower base and enclosure in particular through the waste outlet, along line I-I of FIG. 2.

Preferably a shower base of the invention also includes a formation or formations around or along a part of the front side of the shower base for mounting a return panel or panels to the shower base on one or both sides of the door of the shower enclosure. In the preferred form shown a step 21 is formed at the peripheral edge of the floor of the shower base where the floor joins the drain channel 11, as shown in FIGS. 3 to 5, to accommodate the rail 18 at the foot of the return panels. The rail 18 at the foot of the return panel may be bonded to the shower base at the step by a silicone bonding agent for example, or alternatively in another embodiment the rail(s) 18 may be omitted and the glass edge of the return panel(s) 2 bonded directly into the step 21. Alternatively again, formation(s) between the periphery of the floor of the shower base and the drain channel may comprise moulded protrusions in the shower base which locate or engage into rail 18 or similar on the foot of one or more return panels, or such formations may be formed in the shower base in any other suitable form to assist in locating the foot of one or more return panels.

Cover plate 9 over the waste outlet 8 may also include drain apertures through the cover plate as shown, or alternatively again a removable cover plate may be dispensed with and a cover plate fixed permanently in place once the shower base has been installed, so that for example when the shower base is tiled the tiles may extend over the cover plate 9 or equivalent having a planar surface substantially contiguous with the floor 6 of the shower base, so that the waste outlet is not visually apparent. In most cases, however, it will be desirable to provide a removable cover plate 9 to allow access to the waste outlet periodically for cleaning.

As indicated above, with the shower base of the invention which has a waste outlet to one side of the shower base combined with an associated drain channel, the floor surface of the shower base may substantially planar, ie a single plane, which when the shower base is to be tiled requires less cutting of tiles at any change of plane in the floor surface of the shower base.

While in the preferred form described the shower base floor surface is (single) planar, it is possible that the shower base may be formed so that the floor surface of the shower base comprises intersecting planes, which in the case of a two plane shower base may intersect along a line bisecting the shower base from the rear corner 7 of the shower base to the waste outlet 8 for example, to provide a fall for water at either rear side of the shower base directly towards the waste outlet 8. This is less preferred but where the shower base is to be tiled may still reduce tiling work relative to tiling a shower base with a central waste and in which the floor surface of the shower base is split into four different planes.

In the preferred form described the waste outlet 8 is provided centrally at the front of the shower base but an alternative form the waste outlet might be provided at the left or right front corners of the shower base, in which case the fall of the drain channel 11 would be towards the waste outlet at one side rather than from either side of the front closure towards a central waste outlet.

The foregoing describes the invention including a preferred form thereof. Alterations and modifications as well be obvious those skilled in the art are intended to be incorporated in the scope hereof as defined in the accompanying claims.

The invention claimed is:

1. A shower enclosure comprising:

a door;

a return panel disposed on at least one side of the door, the return panel having a foot; and a shower base having a front side, an integral formation, a floor which falls towards the front side of the shower base, a waste outlet, and a drain channel that extends around the front side of the shower base and exterior to the door and the return panel, wherein the drain channel is arranged to drain into the waste outlet;

wherein the integral formation is shaped to mount the foot thereto, such that the shower base supports the return panel along the foot;

wherein a gap is disposed between the door and of the shower base and a water drain gap is disposed between the foot and the shower base through which water may flow beneath the door and the return panel to the drain channel.

2. The shower enclosure of claim 1, further comprising a gap between the at least one side of the door and the return panel, through which water may pass.

3. The shower enclosure of claim 1, further comprising a longitudinally extending cover member over the drain channel.

4. The shower enclosure of claim 1, wherein the floor of the shower base is substantially planar whereby the floor of the shower base may be tiled without requiring cutting of the tiles to accommodate changes in plane of the floor of the shower base.

5. The shower enclosure of claim 4, wherein the floor of the shower base falls from a high point at a rear side of the shower base to the front side of the shower base.

6. The shower enclosure according to of claim 1, wherein the waste outlet is recessed into the shower base so as to be at a lower level than the surface of the floor of the shower base and a cover member is provided over the waste outlet.

7. The shower enclosure of claim 6, wherein the cover member of the waste outlet has a substantially planar top surface whereby the top surface of the cover member may be tiled and wherein the top surface of the cover member is substantially contiguous with the floor of the shower base.

8. The shower enclosure of claim 1 wherein the shower base at the front side is not higher than the floor of the shower base adjacent the door to the enclosure.

9. A pre-fabricated shower base for use in a shower, the shower base comprising:

a front side;

a floor which falls towards the front side and which comprises substantially a single plane whereby the floor may be tiled without requiring cutting of flat tiles to accommodate changes in plane of the floor;

a waste outlet provided near the said front side;

a drain channel that extends around or across the front side of the shower base and which is arranged to drain into the waste outlet; and a formation disposed around the front side of the shower base for mounting to the shower base a return panel of a shower enclosure disposed on a side of a door of the shower enclosure along a foot of the return panel, the formation being disposed between a periphery of the floor and the drain channel; and an integral water drain cut-out through the formation for water to flow beneath the return panel supported by the formation.

10. The shower base of claim 9, further comprising a longitudinally extending cover member over the drain channel.

11. The shower base of claim 9 wherein the floor of the shower base falls from a high point at a rear side of the shower base to the front side of the shower base.

12. The shower base of claim 9, wherein the waste outlet is recessed into the shower base so as to be a lower level than the surface of the floor of the shower base and a cover member is provided over the waste outlet.

13. The shower base of claim 12, wherein the cover member of the waste outlet has a substantially planar top surface whereby the top surface of the cover member may be tiled and wherein the top surface of the cover member is substantially contiguous with the floor of the shower base.

14. The shower base of claim 9, wherein the shower base at the front side is not higher than the floor of the shower base adjacent the door to the enclosure.

15. The shower enclosure of claim 1, wherein the integral formation includes a step formed at a peripheral edge of the floor adjacent the drain channel to receive on the step the foot of the return panel and support the return panel from the shower base.

16. The shower enclosure of claim 1, wherein the water drain gap includes a water drain cut-out that is integral in the shower base through the integral formation.

17. The shower base of claim 9, wherein the integral formation includes an integral step formed at the peripheral edge of the floor adjacent the drain channel to receive on the step a foot of the return panel and support the return panel from the shower base.

18. A shower enclosure comprising:

a door disposed at a front side of the enclosure;

a return panel disposed on a side of the door; and a shower base comprising:

a front side;

a floor which falls towards the front side of the shower base;

a waste outlet provided near the front side of the shower base;

a drain channel which extends around or across the front side beneath and exterior to the door and the return panel, the drain channel being arranged to drain into the waste outlet; and an integral formation or between a periphery of the floor and the drain channel, the integral formation being shaped to receive a foot of the return panel and support from the shower base the return panel along the foot of the return panel;

wherein a gap is located between a bottom edge of the door and the front side of the shower base; and wherein the shower base also includes an integral water drain cut-out through the integral formation for water to flow beneath the return panel supported by the integral formation.

19. The shower enclosure of claim 18, wherein the floor of the shower base comprises a substantially single plane.

20. The shower enclosure of claim 18, further comprising a longitudinally extending cover member over the drain channel.

21. The shower enclosure of claim 19, wherein the floor of the shower base falls from a high point at a rear side of the shower base to the front side of the shower base.

22. The shower enclosure of claim 18, wherein the waste outlet is recessed into the shower base so as to be at a lower level than the surface of the floor of the shower base and a cover member is provided over the waste outlet.

23. The shower enclosure of claim 22, wherein the cover member of the waste outlet has a substantially planar top surface whereby the top surface of the cover member may be tiled and wherein the top surface of the cover member is substantially contiguous with the floor of the shower base.

* * * * *